US008650920B2

(12) United States Patent
Bayer et al.

(10) Patent No.: US 8,650,920 B2
(45) Date of Patent: Feb. 18, 2014

(54) METHOD AND DEVICE FOR SURFACE PEENING OF A COMPONENT IN THE REGION OF A PASSAGE OPENING

(75) Inventors: Erwin Bayer, Dachau (DE); Eggert Reese, Oberpframmern (DE); Juergen Steinwandel, Uhldingen-Muehlhofen (DE)

(73) Assignee: MTU Aero Engines GmbH, Munich (DE)

( * ) Notice: Subject to any disclaimer, the term of this patent is extended or adjusted under 35 U.S.C. 154(b) by 539 days.

(21) Appl. No.: 12/666,266

(22) PCT Filed: Jun. 6, 2008

(86) PCT No.: PCT/DE2008/000968

§ 371 (c)(1),
(2), (4) Date: Dec. 22, 2009

(87) PCT Pub. No.: WO2009/000232

PCT Pub. Date: Dec. 31, 2008

(65) Prior Publication Data

US 2010/0186472 A1 Jul. 29, 2010

(30) Foreign Application Priority Data

Jun. 26, 2007 (DE) ..... 10 2007 029 491

(51) Int. Cl.
*C21D 7/06* (2006.01)
*B21C 37/00* (2006.01)

(52) U.S. Cl.
USPC ..... 72/53; 29/90.7

(58) Field of Classification Search
USPC ..... 72/53, 710; 29/90.7
See application file for complete search history.

(56) References Cited

U.S. PATENT DOCUMENTS

| | | | | |
|---|---|---|---|---|
| 3,695,091 | A * | 10/1972 | Smith | 73/11.02 |
| 6,189,356 | B1 | 2/2001 | Simeone et al. | |
| 2003/0115922 | A1* | 6/2003 | Berthelet et al. | 72/53 |
| 2006/0021410 | A1* | 2/2006 | Cheppe et al. | 72/53 |

FOREIGN PATENT DOCUMENTS

| | | | |
|---|---|---|---|
| DE | 10 2004 059 592 | A1 | 5/2006 |
| EP | 1 623 794 | A | 2/2006 |
| FR | 2 714 629 | A | 7/1995 |
| RU | 2 139 785 | C1 | 10/1999 |
| SU | 1 009 735 | A1 | 4/1983 |

* cited by examiner

*Primary Examiner* — Debra Sullivan
(74) *Attorney, Agent, or Firm* — Crowell & Moring LLP

(57) ABSTRACT

A method and device for surface peening, particularly ultrasonic shot peening, of a component in the region of a passage opening is disclosed. A vibration device impinging the blasting material is disposed on one side and a counter-element is disposed on an opposite side relative to a component region having the passage opening. The counter-element is disposed at a distance relative to the corresponding side of the component region.

18 Claims, 1 Drawing Sheet

METHOD AND DEVICE FOR SURFACE PEENING OF A COMPONENT IN THE REGION OF A PASSAGE OPENING

BACKGROUND AND SUMMARY OF THE INVENTION

This application claims the priority of International Application No. PCT/DE2008/000968, filed Jun. 6, 2008, and German Patent Document No. 10 2007 029 491.5, filed Jun. 26, 2007, the disclosures of which are expressly incorporated by reference herein.

The invention relates to a method and a device for surface peening, in particular for ultrasonic shot peening, of a component in the region of a passage opening.

Such a method and such a device are already known, for example, from German Patent Document No. DE 10 2004 059 592 A1. In it, a device is used which comprises a vibration device in the form of an ultrasonic sonotrode for impinging or accelerating the blasting material, as well as respective counter-elements. To peen the passage opening, the vibration device is disposed on one side and the respective counter-element is disposed on the opposite side relative to a component region having the passage opening. The peening of the component is then done in two steps. During the first step, the marginal region facing the vibration device is peened between the surface of the corresponding side of the component region and an inner surface of the passage opening. A counter-element is used for this which is inserted in the passage opening like a hatch pin. The counter-element and the passage opening therefore have substantially identical cross-sections.

In a second step, another type of counter-element is used which, on the side of the component opposite the vibration device, lies plane on the corresponding surface of the equivalent component region. Overall, as a result of the two steps of the surface peening, homogeneous strengthening of the surfaces in the region of the passage opening is to be created, in order to create a connection of the component—a rotor blade of a gas turbine in that invention—which is extremely resistant to failure due to crack formation.

The aim of the present invention is to create a method and a device of the type described above by means of which particularly reliable and uniform strengthening of the component region having the passage opening can be achieved.

To allow extremely reliable and uniform strengthening of the component in the region of the passage opening, in the method in accordance with the invention the counter-element is disposed at a distance to the corresponding side of the component region. In other words, in accordance with the invention the counter-element, in contrast to the prior art in accordance with DE 10 2004 059 592 A1, is not to be positioned directly on the corresponding surface region of the component and instead a corresponding distance must be provided for.

It is therefore achieved in an extremely simple and reliable way that, for example, a marginal region between a surface of the corresponding side of the component region facing the counter-element and an inner surface of the passage openings are uniformly surface peened. In conjunction with that, satisfactory rounding of a marginal region that was originally substantially angular in cross-section can be achieved so that it has a desired rounding or a corresponding radius after the surface peening has been done.

As a result of the distanced arrangement relative to the equivalent surface of the corresponding side of the component region, it is, moreover, achieved that the surface close to the passage opening is also particularly reliably strengthened. A further advantage is that both of the opposing marginal regions between the respective surfaces and the inner surface of the passage opening can be simultaneously surface peened, so that the entire component can be worked in one processing step in the region of the passage opening.

In particular, the present invention creates a method that can provide targeted treatment of passage openings or bore holes in components made of basic aluminum alloys, which tend to develop cracks in the event of, for example, corresponding vibrational stress and/or static force or the application of pressure. It is thus very important in the case of such components to be able to induce a homogeneous residual compressive stress profile in the region of the passage opening. That is achieved in a particularly advantageous way using the present method.

The counter-element is preferably also constructed as a sonotrode, which in addition to the aforementioned advantages, leads to greater homogeneity of the peening results and to a reduction in peening time.

In a further arrangement of the invention, it has also been shown to be advantageous when a non-planar inner side of the counter-element facing the passage opening is used by means of which a marginal region between a surface of the corresponding side of the component region and an inner surface of the passage opening is surface peened. In other words, by using a non-planar inner side of the counter-element, it is achieved that the marginal side between the respective surface of the component and the inner surface of the passage opening can be ideally strengthened or rounded. It is naturally achieved in addition that the inner surface, particularly in the upper region—i.e., near the counter-element—is also peened particularly well and uniformly.

In a further arrangement of the invention, it has also been shown to be advantageous when a deflection tool is disposed in the passage opening. As a result of such a deflection tool, whose cross-section is dimensioned smaller than the corresponding passage opening, targeted deflection of the blasting material that is accelerated by the vibration device in the direction of the inner surface of the passage opening is achieved so that the latter is particularly reliably and homogeneously strengthened.

In that context, it has also been shown to be positive if the deflection tool is disposed in the passage opening from the side of the counter-element. As a result, the deflection tool is preferably positioned on the side opposite the vibration device so that the blasting material accelerated by the vibration device is deflected in a particularly advantageous manner by means of the deflection tool, particularly in the direction of the inner surface of the passage opening.

It has also been shown to be advantageous when the deflection tool is disposed jointly with the counter-element relative to the surface region of the component having the passage opening. This results in an arrangement of the counter-element and the deflection tool which is particularly simple with regard to process technology, whereby it can also be ensured in a simple manner that the counter-element and the deflection tool are always constantly positioned relative to each other. This therefore allows particularly good reproducibility of the surface peening to be ensured. In that context, it has been shown to be particularly advantageous in a further arrangement of the invention when the deflection tool and the counter-element are constructed as one piece.

The deflection tool whose cross-section is dimensioned smaller than the passage opening is also preferably disposed in a central region of the passage opening so that it has a distance to the corresponding inner surface of the passage opening that is preferably uniform toward all sides. Particularly homogeneous strengthening of the inner surface of the passage opening is achieved as a result.

It is also advantageous when the deflection tool is disposed over a partial length of the passage opening within the latter. Because experience shows that the inner surface of the passage opening is sufficiently strengthened near the vibration device, it is particularly necessary that the deflection tool is positioned in the partial length of the passage opening which is disposed farther from the vibration device. Consequently, overall, an extremely homogeneous or uniform strengthening of the inner surface of the passage opening is ensured by a deflection tool positioned over only a partial length of the passage opening.

It is also advantageous when a surface of the vibration device impinging the blasting material is disposed at a distance to the corresponding side of the surface region of the component. It can thereby be ensured that the surface of the corresponding side of the component region facing the vibration device or a marginal region between that surface and the inner surface of the passage opening is particularly reliably strengthened or rounded. Thus, if, overall, both the counter-element and the vibrating surface of the vibration device are disposed at a respective distance to the corresponding surface of the component, particularly reliable strengthening of the two marginal regions between the respective surfaces and the inner surface of the passage opening can be achieved.

To achieve a particularly advantageous strengthening of the component in the region of the passage opening, it has also proven to be advantageous when the surface region of the component having the passage opening is disposed substantially horizontally and the vibration device is disposed below the surface region.

Finally, a method has proven to be advantageous in which the component region is positioned within a peening chamber in which the vibration device and the counter-element are also disposed in addition to it. As a result of such a peening chamber, the quantity of blasting material can be kept uniform in a simple manner, so that an extremely reproducible peening result can be obtained.

The advantages described above in connection with the method in accordance with the invention also apply to the device. It is also distinguished in particular in that, in addition to the vibration device, at least one counter-element is used which is positionable at an equivalent distance to the corresponding side of the component region. It is clear that such a device can be designed both as a static unit that remains stationary and as mobile equipment. Accordingly, with the static arrangement of the device, the component is positioned on the device—relative to the vibration device and the counter-element—while a mobile device is disposed relative to a stationary component.

The deflection tool that is described above has, in a further arrangement of the invention, on its free end a deflection point that also ensures that blasting material that is accelerated by the vibration device moves in the direction of the inner surface of the passage opening in a particularly advantageous manner.

Finally, it has also proven to be advantageous in the device in accordance with the invention when a holding device is provided by means of which the surface region of the component having the passage opening can be disposed relative to the vibration device or the counter-element.

Additional advantages, features, and details of the invention are contained in the description below of a preferred example of an embodiment and in reference to the drawings.

DETAILED DESCRIPTION OF THE DRAWINGS

As an example, exposed locations occur in aircraft construction on which there are, for example, bolt fasteners with a high application of force or pressurization. An example of such exposed locations is engine and surface mountings or mounting locations for external loads such as auxiliary tanks or weapons. With passage openings for bolts made of light metals such as basic aluminum alloys, which generally accept bolts made of a Fe/Ni material, vibrational and stress crack corrosion, for example, must be anticipated. The damage occurs in any case on the side of the light metal, i.e., in the region of the passage opening for the bolt. Untreated surfaces lead, as a function of relevant parameters such as pressure, the application of force, or shrinkage stress, to rapid failure as a result of massive crack formation. It is therefore absolutely necessary to establish an appropriate residual compressive stress profile or appropriate strengthening in the marginal layer of corresponding passage openings.

For that reason, the present invention suggests a method or a device by means of which residual compressive stresses can be induced to avoid stress crack corrosion or the like.

Figure 1:
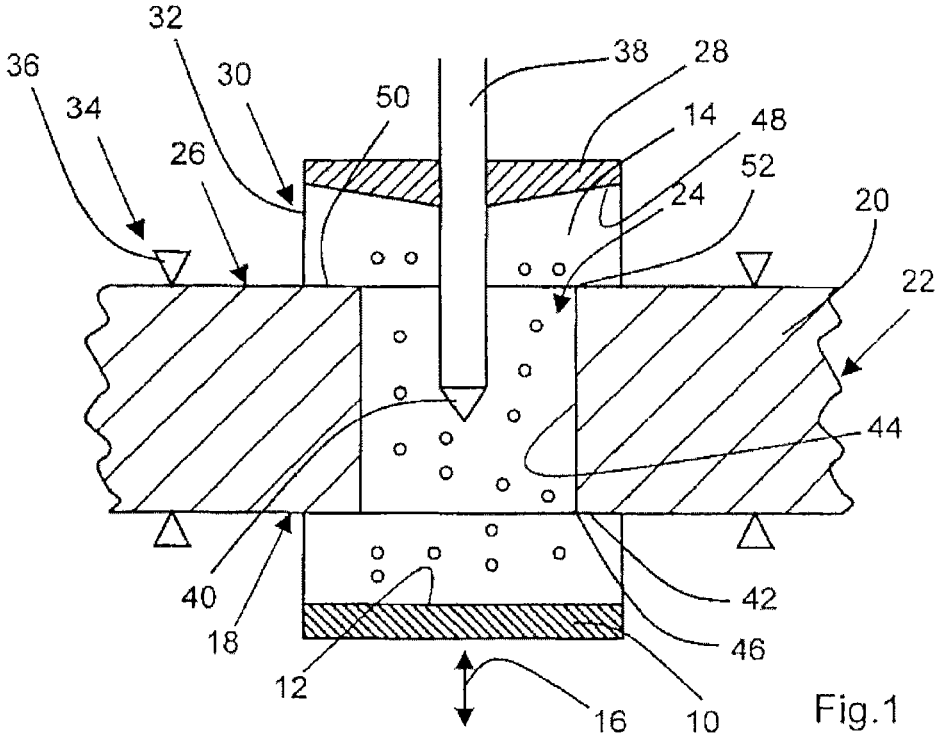
FIG. 1 shows a schematic section view through a device for ultrasonic shot peening of a component in the region of a passage opening in which a vibration device impinging the blasting material is disposed on a lower side and a counter-element is disposed on an opposing upper side relative to the component region having the passage opening and in which both the vibration device and the counter-element are disposed at a respective distance to the corresponding side of the component region.

For that purpose, a device in accordance with FIG. 1 comprises a vibration device 10 shown in cross-section, which comprises a corresponding surface 12 by means of which blasting material—in the form of steel shot 14 in the present invention—can be impinged or accelerated. Vibration device 10 in the present invention is constructed for example as an ultrasonic sonotrode and oscillates—as shown by double arrow 16—approximately perpendicular in relation to its surface 12. It will be seen from FIG. 1 that vibration device 10 is disposed on a lower side 18 of a component region 20 of a component 22 shown in cross-section and running approximately horizontally in the present invention.

In component region 20 of component 22, a passage opening 24 is provided which has, in the present invention, for example, a circular cross-section and is used to receive a bolt. Component 22 can, for example, be a light component from aircraft construction which is, in particular, made of a base aluminum alloy. A multiplicity of other components from aircraft construction, particularly also in the form of engine parts, would naturally also be conceivable. It would naturally also be conceivable for the described device or the associated method to be used for components outside of aircraft construction.

FIG. 1 also shows that on an upper side 26 of component region 20 of component 22 opposite vibration device 10, a counter-element 28 is disposed whose function will be described in greater detail below. Counter-element 28 is also shown here in a schematic section view.

It will be seen that both vibration device 10 and counter-element 28 completely cover the clear cross-section of passage opening 24. Vibration device 10 and counter-element 28 are allocated to a peening chamber 30 whose peening chamber walls 32 are shown only very schematically in FIG. 1 by corresponding lines. It should therefore be explicitly noted that vibration device 10 or its vibrating surface 12 are constructed movably or vibratingly relative to peening chamber 30 or its peening chamber walls 32.

Component region 20 of component 22 is held in the present invention by means of a holding device 34 or by means of holding elements 36, which are shown only very schematically, in such a way that passage opening 24 is positioned within peening chamber 30. Moreover, the arrangement or positioning of vibration device 10, counter-element 28, and component region 20 in relation to each other is achieved as a result of holding device 34 or holding elements 36.

A deflection tool 38 is disposed within passage opening 24 from upper side 26, i.e., from the side of counter-element 28. It will be seen that deflection tool 38 is constructed with a smaller cross-section than the cross-section of passage opening 24. It will also be seen that deflection tool 38 is disposed in a central region of passage opening 24 and is disposed over a partial length of passage opening 24 within it. In this embodiment, that partial length corresponds to approximately half the width of component region 20. On its free end facing vibration device 10, deflection tool 38 comprises a deflection point 40 whose function will also be described in greater detail below. Deflection tool 38 can be built separately as well as in one piece with counter-element 28. In one embodiment, deflection tool 38 is disposable jointly with counter-element 28 relative to component region 20 having passage opening 24.

The method for ultrasonic shot peening of component region 20 comprising passage opening 24 which is to be carried out by means of the described device is distinguished in particular by the induction of an extremely homogeneous residual compressive stress profile or extremely homogeneous strengthening. Because surface 12 of vibration device 10 is disposed at a distance to corresponding lower side 18, a portion of shot 14 that is accelerated by means of surface 12 hits a surface 42 of lower side 18. Moreover, a portion of shot 14 directly hits the lower region of an inner surface 44 of passage opening 24. Furthermore, marginal region 46 between surface 42 and inner surface 44 of the passage opening is uniformly surface peened, so that marginal region 46 is on the one hand strengthened and on the other hand correspondingly—provided with a radius—rounded.

A portion of shot 14 that is accelerated by means of surface 12 of vibration device 10 is, moreover, deflected or diverted in such a way by means of deflection tool 38 or deflection point 40 that shot 14 moves in particular in the direction of the upper region of inner surface 44 of passage opening 24. Thus, as a result of deflection tool 38, homogeneous strengthening or a homogeneous residual compressive stress profile is achieved over the entire inner surface 44 of passage opening 24.

Another portion of shot 14 that is accelerated by means of surface 12 of vibration device 10 impacts on counter-element 28, which is disposed at a distance to corresponding upper side 26 of component region 20. An inner side 48 of counter-element 28 facing passage opening 24 is not planar but rather, in the present invention, slightly conical or tapered. As a result, it is achieved in particular that the shot hitting inner side 48 is obliquely deflected toward the outside so that on the one hand a surface 50 of upper side 26 of component region 20 and on the other hand in particular a marginal region 52 between surface 50 and inner surface 44 of passage opening 24 is strengthened. Marginal region 52 between surface 50 and inner surface 44 is simultaneously strengthened and—provided with a radius—rounded. It should be considered within the framework of the invention that inner surface 44 could also have a different configuration, in particular a rounded shape.

As discussed above, both counter-element 28 and vibration device 10 are located within peening chamber 30, so the quantity of blasting material or steel shot 14 can be kept uniform in a simple manner. A particularly reproducible strengthening result is achieved through this. Moreover, corresponding sealing elements or the like can be provided between peening chamber 30 and component region 20 in order to prevent undesirable loss of blasting material.

A particularly reproducible peening result is also achieved as a result of the horizontal arrangement of component region 20 and surface 12 of vibration device 10 in the present invention. Since vibration device 10 is disposed on lower side 18 of component region 20, the blasting material returns to vibration device 10 in a simple manner solely due to its force of gravity.

Overall, it can therefore be seen that in the present invention a method and a device are created by means of which an extremely homogenous residual compressive stress profile can be produced in the marginal layers—in the present invention surfaces 42 and 50, marginal regions 46 and 52, and inner surface 44 of passage opening 24. When that is done, counter-element 28 in particular ensures that steel shot leaving passage opening 24 toward the top is preferably aimed at upper marginal region 52 and leads to rounding. This effect is obtained from the outset on lower side 18 on lower marginal region 46. To enhance the effect on inner surface 44, deflection tool 38 is guided against the lower side from the top, as a result of which homogeneous strengthening is achieved.

Figure 2:
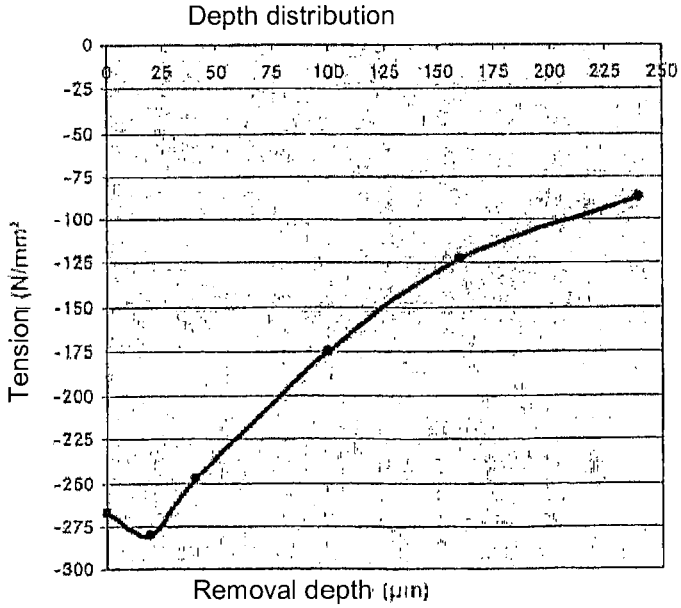
FIG. 2 shows a schematic diagram of the depth distribution of the strengthening or the residual compressive stress profile in the strengthened marginal layers or surfaces of the component, particularly in the region of the passage opening.

FIG. 2 shows in a schematic diagram the depth distribution of the strengthening or the residual compressive stress profile in the strengthened marginal layers or surfaces of the component, particularly in the region of the passage opening, with the stress shown on the y-axis and the removal shown on the x-axis. This shows in particular the homogeneous strengthening of the corresponding components.

The invention claimed is:

1. A method for surface peening of a component in a region of a passage opening, comprising the steps of:

impinging a blasting material by a vibration device disposed on a first side relative to a component region of the component having the passage opening; and impinging the blasting material by a counter-element disposed on a second side relative to the component region of the component having the passage opening, wherein the first side is opposite the second side;

wherein the counter-element is disposed at a distance relative to the second side of the component region and wherein the counter-element is a sonotrode;

wherein the counter-element is used with a non-planar inner side of the counter-element facing the passage opening, wherein a marginal region is peened by the non-planar inner side between a surface of the component region and an inner surface of the passage opening;

and wherein a deflection tool is disposed in the passage opening.

2. The method in accordance with claim 1, wherein the deflection tool is disposed in the passage opening from a side of the counter-element.

3. The method in accordance with claim 1, wherein the deflection tool is disposed jointly with the counter-element relative to the component region having the passage opening.

4. The method in accordance with claim 1, wherein the deflection tool has a cross-section that is dimensioned smaller than the passage opening and is disposed in a central region of the passage opening.

5. The method in accordance with claim 1, wherein the deflection tool is disposed over a partial length of the passage opening within the passage opening.

6. The method in accordance with claim 1, wherein a surface of the vibration device impinging the blasting material is disposed at a distance to the first side of the component region.

7. The method in accordance with claim 1, wherein the component region having the passage opening is disposed substantially horizontally and the vibration device is disposed below the first side.

8. The method in accordance with claim 1, wherein the component is made of a base aluminum alloy.

9. The method in accordance with claim 1, wherein the component region having the passage opening is positioned within a peening chamber in which the vibration device and the counter-element are disposed.

10. A device for surface peening of a component in a region of a passage opening, comprising:

a vibration device;

a counter-element; and a deflection tool disposable in the passage opening;

wherein the vibration device and the counter-element are disposable on opposing sides relative to a component region of the component having the passage opening;

wherein the counter-element is disposable at a distance relative to a side of the component region and wherein the counter-element is a sonotrode;

and wherein the counter-element has a non-planar inner side facing the passage opening, wherein a marginal region is peenable by the non-planar inner side between a surface of the component region and an inner surface of the passage opening.

11. The device in accordance with claim 10, wherein the deflection tool is disposable in the passage opening from a side of the counter-element.

12. The device in accordance with claim 10, wherein the deflection tool is disposable jointly with the counter-element relative to the component region having the passage opening.

13. The device in accordance with claim 10, wherein a cross-section of the deflection tool is smaller than the passage opening and wherein the deflection tool is disposable in a central region of the passage opening.

14. The device in accordance with claim 10, wherein the deflection tool is disposable over a partial length of the passage opening within the passage opening.

15. The device in accordance with claim 10, wherein the deflection tool has a deflection point on a free end.

16. The device in accordance with claim 10, wherein a surface of the vibration device is disposable at a distance to a side of the component region.

17. The device in accordance with claim 10, further comprising a holding device, wherein the component region having the passage opening is disposable substantially horizontally in the holding device and wherein the vibration device is disposable below the component region in the holding device.

18. The device in accordance with claim 10, further comprising a peening chamber, wherein the vibration device and the counter-element are disposed within the peening chamber and wherein the component region having the passage opening is positionable in the peening chamber.

* * * * *